US005638948A

United States Patent [19]

Sharaf et al.

[11] Patent Number: 5,638,948

[45] Date of Patent: Jun. 17, 1997

[54] ELECTRIC TRANSFER SWITCH HAVING THREE-POSITION TOGGLE MECHANISM

[75] Inventors: Nadir Sharaf, Mounds View; Rickie Allen Evenson, Ham Lake; Alan Norman Fabian, Roseville, all of Minn.

[73] Assignee: Onan Corporation, Minneapolis, Minn.

[21] Appl. No.: 469,006

[22] Filed: Jun. 5, 1995

[51] Int. Cl.[6] ..... H01H 23/00

[52] U.S. Cl. ..... 200/401; 200/553; 200/462; 200/465

[58] Field of Search ..... 200/401, 553, 200/554, 557, 562, 462, 465, 466, 6 R, 7, 15, 47; 74/97.1, 100.1

[56] References Cited

U.S. PATENT DOCUMENTS

| | | | |
|---|---|---|---|
| 1,516,440 | 11/1924 | Johnson . | |
| 1,720,189 | 7/1929 | Jackson . | |
| 2,306,235 | 12/1942 | Walle . | |
| 2,807,684 | 9/1957 | Ayers | 74/97.1 |
| 2,989,603 | 6/1961 | Mikos et al. . | |
| 3,246,100 | 4/1966 | Russell . | |
| 3,345,485 | 10/1967 | Engel . | |
| 3,430,018 | 2/1969 | Baird . | |
| 3,584,170 | 6/1971 | Bould . | |
| 3,603,755 | 9/1971 | Ranzanigo . | |
| 4,132,968 | 1/1979 | Lang . | |
| 4,245,140 | 1/1981 | Jencks et al. . | |
| 4,408,111 | 10/1983 | Domhan et al. . | |
| 4,459,445 | 7/1984 | Hisatsune et al. . | |
| 4,650,946 | 3/1987 | Maier et al. . | |
| 4,791,393 | 12/1988 | Flick et al. . | |
| 4,849,590 | 7/1989 | Becker et al. . | |
| 4,855,549 | 8/1989 | Toda et al. | 200/401 |
| 4,891,618 | 1/1990 | Paton . | |
| 4,999,598 | 3/1991 | Jannesari et al. . | |
| 5,004,875 | 4/1991 | Moody et al. . | |
| 5,027,096 | 6/1991 | White et al. . | |
| 5,073,764 | 12/1991 | Takahashi et al. . | |
| 5,089,795 | 2/1992 | Morgan et al. . | |

FOREIGN PATENT DOCUMENTS

| | | |
|---|---|---|
| 1141052 | 1/1969 | United Kingdom . |

*Primary Examiner*—David J. Walczak

*Attorney, Agent, or Firm*—Merchant, Gould, Smith, Edell, Welter & Schmidt, P.A.

[57] ABSTRACT

An electric transfer switch includes a three-position toggle mechanism and a crossbar which is mounted on the toggle mechanism. The crossbar carries a plurality of moveable contacts and is rotated by the toggle mechanism. The moveable contacts normally contact one set of the stationary contacts in one closed position which are connected to a normal main power supply. The moveable contacts are rotated to a neutral non-power line in an open position, and are further rotated to another closed position, which are connected to a standby emergency power supply to supply electricity to the transferred electrical loads. The toggle mechanism includes a multi-bar linkage which is rotated by a handle of the toggle mechanism among the open position and two closed positions. A plurality of springs and catches are used to maintain the contact between the moveable contacts and the stationary contacts, even when a "fault" current passes through the contact tips of the moveable and stationary contacts.

13 Claims, 14 Drawing Sheets

ELECTRIC TRANSFER SWITCH HAVING THREE-POSITION TOGGLE MECHANISM

FIELD OF THE INVENTION

The present invention relates to an electric transfer switch, more particularly, to an electric transfer switch having a three-position toggle mechanism.

BACKGROUND OF THE INVENTION

A typical electric transfer switch (or circuit beaker) is used to switch electric loads from a normal main utility power supply to a standby emergency power supply when a power outage occurs caused by a variety of reasons, for example, earthquake, flooding, bombing, or other utility blackouts, and of course, it is used to switch electric loads from the standby emergency power supply back to the normal main utility power supply when the power outage is over.

In an electric transfer switch, one of the concerns is to control the transition time in switching from the main power supply to the standby emergency power supply. For example, it may be necessary to disconnect loads from both electric power supplies for a controllable time period to allow residual electricity to dissipate or discharge before being switched to the standby power source so that the transferred loads are appropriately switched over. Accordingly, the electric loads should be in a neutral position for a controllable period of time, whereby the electric loads do not contact either of the electric power supplies, e.g. the normal main utility power supply and the standby emergency power supply.

In addition, for a quick release/make operation, it may be necessary to store energy in a mechanism, e.g., a toggle mechanism, which can be used to open or close moveable contacts with respect to stationary contacts of an electric transfer switch. After connecting the moveable contacts to the stationary contacts, i.e., after moving the moveable contacts from a neutral open position to a closed position, it is required to lock the toggle mechanism in the closed position to maintain the contact between the moveable contacts and the stationary contacts. Further, in the closed position, when a "fault" current occurs, it is required not only to maintain the contact between the moveable contacts and the stationary contacts, but also lock the contacts in closed position so that the repulsive forces at contacts may not open the switch. Accordingly, it is desired to design an electric transfer switch having a toggle mechanism which solves these problems.

U.S. Pat. No. 5,004,875 discloses a stored energy contact operating mechanism for opening and closing primary contacts of a circuit breaker. However, the patent does not solve the above problems in an electric transfer switch.

U.S. Pat. No. 4,999,598 relates to a three-position actuating mechanism for an electric transfer switch for opening and closing moveable contacts with respect to contact blocks (stationary contacts) which are connected to various power sources, respectively. However, this type of three-position actuating mechanism does not lock the moveable contacts in a closed position so as to maintain contact between the moveable contacts and the stationary contacts. Further, a quick release/make contact of the electric transfer switch is not possible in this type of three-position actuating mechanism as disclosed in this patent.

The present invention provides an electric transfer switch having a three-position toggle mechanism, which solves these and many other problems associated with existing electric transfer switches.

SUMMARY OF THE INVENTION

The present invention relates to an electric transfer switch, more particularly, to an electric transfer switch having a three-position toggle mechanism.

In one embodiment, the present invention comprises a toggle mechanism for moving an electric transfer switch among three positions which include a normal main power supply position, a standby emergency power supply position, and a neutral non-power supply position. The toggle mechanism is used in conjunction with an electric transfer switch of the type having a plurality of moveable contacts mounted on a rotatable crossbar. The moveable contacts are movable between first and second sets of stationary contacts corresponding to two different power supplies, for example, a normal main power supply and a standby emergency power supply.

Still in one embodiment, the toggle mechanism includes a six-bar linkage which carries the rotatable crossbar. The toggle mechanism also includes a set of springs which are in conjunction with the six-bar linkage. Mechanical energy is stored in the springs which are utilized for a quick release/make operation.

Further, the toggle mechanism includes a handle. In one embodiment, the handle has a handle portion and a body portion. One end of the springs is connected to the body portion so that the springs are moved along with the handle upon actuation. The links of the six-bar linkage are rotated by rotating the handle accordingly. The rotation of the handle is transversal relative to a longitudinal axis of the crossbar. Accordingly, the handle transversely rotates the crossbar so as to change the position of the electric transfer switch among the three positions. The handle can be operated either by manual or by other type of devices, such as solenoid.

Still in one embodiment, the transversal rotation of the handle causes extension of at least one set of springs. After the handle rotates certain angles, one end of the spring, which would extend, crosses a line which joins two pivot points of the links. The links are then forced to rotate very fast which utilizes all the energy stored in the springs during the rotation, and in turn, to force a link, which is connected to the crossbar, to rotate so as to rotate the crossbar. Accordingly, the moveable contacts which are carried by the crossbar are rotatably moved from the neutral open position to a closed position whereby the moveable contacts and the corresponding stationary contacts are electrically connected to one another.

In the closed position, the linkage is locked so as to prevent the linkage from incidentally restoring to the neutral position, which disconnects the moveable contacts from the stationary contacts. In one embodiment, until the end of the spring reversely crosses back the line which joins two pivot points of the link, i.e., the spring stores enough energy, the crossbar would not be rotated in an opposite direction. Therefore, the linkage prevents the incidental disconnection between the moveable contacts and the stationary contacts due to any incidental mechanical or electromagnetic torque caused by the linkage or generated at the contact tips of the moveable contacts and the stationary contacts.

Still in the closed position, the moveable contacts are biasedly forced downward by a plurality of springs, e.g., leaf springs, or compression springs, etc., so that the moveable contacts normally tightly contact the stationary contacts.

Further in the closed position, when a "fault" current or other unexpected conditions occur, the moveable contacts are further locked by a plurality of catches to maintain the contact between the stationary contacts and the moveable contacts. The catches are formed into an integral catch block which is mounted between the crossbar and the moveable contacts. Each of the catches is disposed between two neighboring moveable contacts. Upon occurrence of a fault current or other unexpected conditions, the neighboring movable contacts electromagnetically attract to each other and engage the catch therebetween. The catches are designed to be in a certain shape so as to force the moveable contacts downward to maintain contact with the stationary contacts.

Still in one embodiment, to switch the electric transfer switch back to the neutral open position or to further move the electric transfer switch to a second closed position, i.e., toward the other set of the stationary contacts, the six-bar linkage is rotated in an opposite direction. The second set of the stationary contacts and the corresponding moveable contacts are generally symmetrical to the first set of the stationary contacts and the corresponding moveable contacts with respect to the longitudinal axis of the crossbar. A similar type of operation is present to connect the moveable contacts to the second set of the stationary contacts. A similar type of springs and catches are used to maintain the contact between the moveable contacts and the stationary contacts.

One particular advantage of the present invention is the stable connection between the moveable contacts and the stationary contacts.

Another advantage is that the present invention uses a simple and effective multi-bar linkage in which energy is stored to make a quick release/make switch among the three switching positions.

Another advantageous feature of the present invention is that in one embodiment, a single handle is used to operate the whole linkage mechanism so as to dramatically reduce the number of actuators which are needed to operate in conventional electric transfer switches.

These and various other advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters generally indicate corresponding parts throughout the following several views:

as shown in FIG. 1.

DETAILED DESCRIPTION OF THE PREFERRED EMBODIMENT

Figure 1:
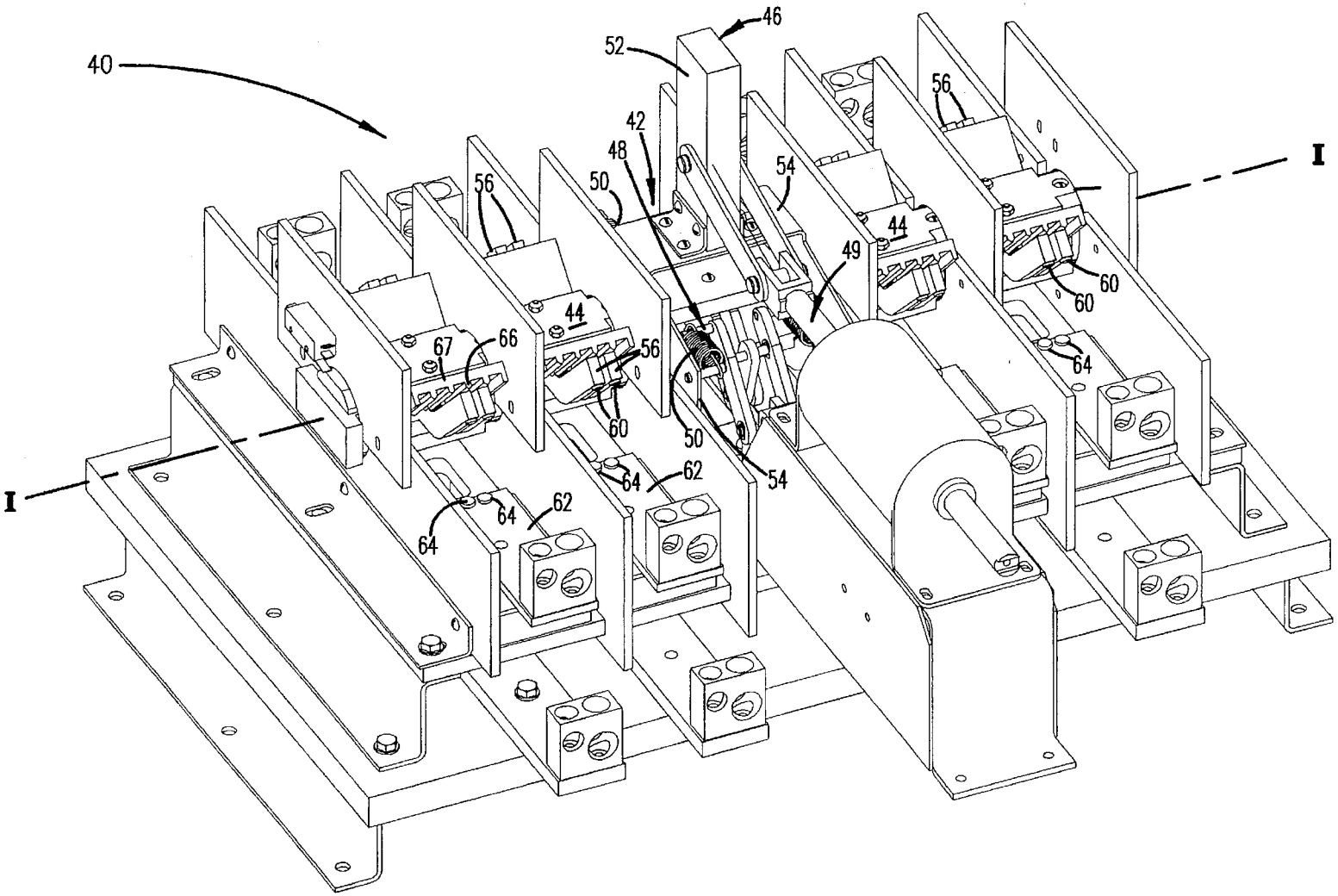
FIG. 1 is a perspective view of an embodiment of an electric transfer switch having a toggle mechanism generally in accordance with the principles of the present invention.

Referring now to the drawings in details, wherein like numerals identify similar elements throughout, FIG. 1 shows an embodiment of an electric transfer switch 40, generally in accordance with the principles of the present invention, including a toggle mechanism 42 and a crossbar 44.

As shown in FIG. 1, the toggle mechanism 42 includes a handle 46, a six-bar linkage 48, and a plurality of springs 50. The handle 46 includes a handle portion 52 and a body portion 54. Each of the springs 50 is connected between the six-bar linkage 48 and the body portion 54 of the handle 46. The crossbar 44, having a longitudinal axis I—I, is retained between the handle 46 and the six-bar linkage 48. The handle 46 and linkage 48 are rotated transversely with respect to the longitudinal axis I—I.

In FIG. 1, the handle 46 can be operated by manual or by other type of devices, such as solenoid 49, etc.

Figure 11:
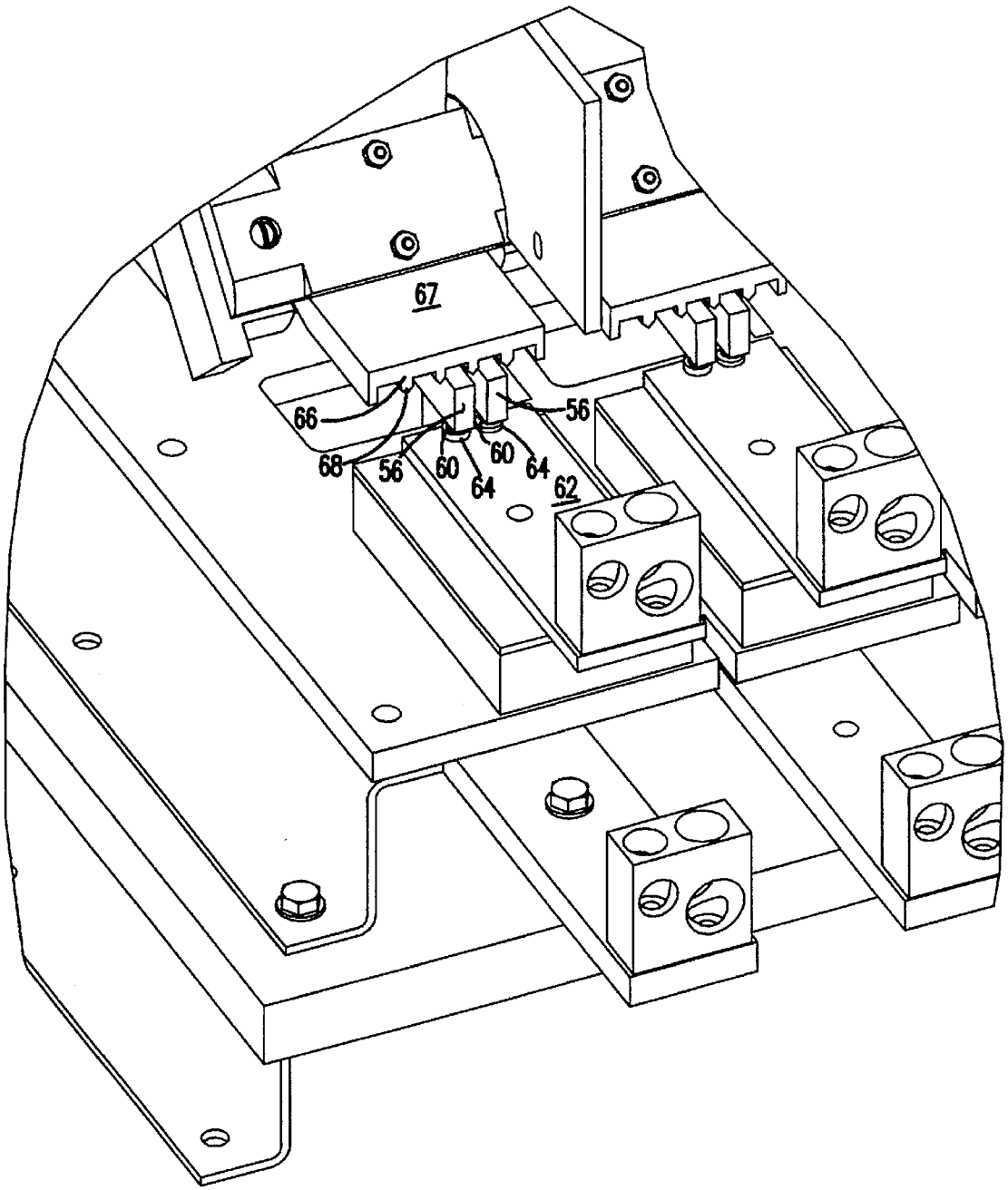
FIG. 11 is an enlarged perspective view of the electric transfer switch in one closed position.

A plurality of moveable contacts 56 are carried by the crossbar 44. Each moveable contact 56 has two contacting ends 58,60 (see details in FIG. 9). The moveable contacts 56 are rotated by the handle 46 from a neutral open position as shown in FIG. 1 to a closed position as shown in FIG. 11, so as to contact a set of stationary contacts 62, or from the neutral open position to another closed position (a mirror imaged position of that of as shown in FIG. 11), so as to contact another set of stationary contacts 62. The second closed position is generally symmetrical to the first closed position with respect to the longitudinal axis I—I. In addition, the second set of the stationary contacts 62 is generally symmetrical to the first set of the stationary contacts 62 with respect to the longitudinal axis A—A.

Figure 2:
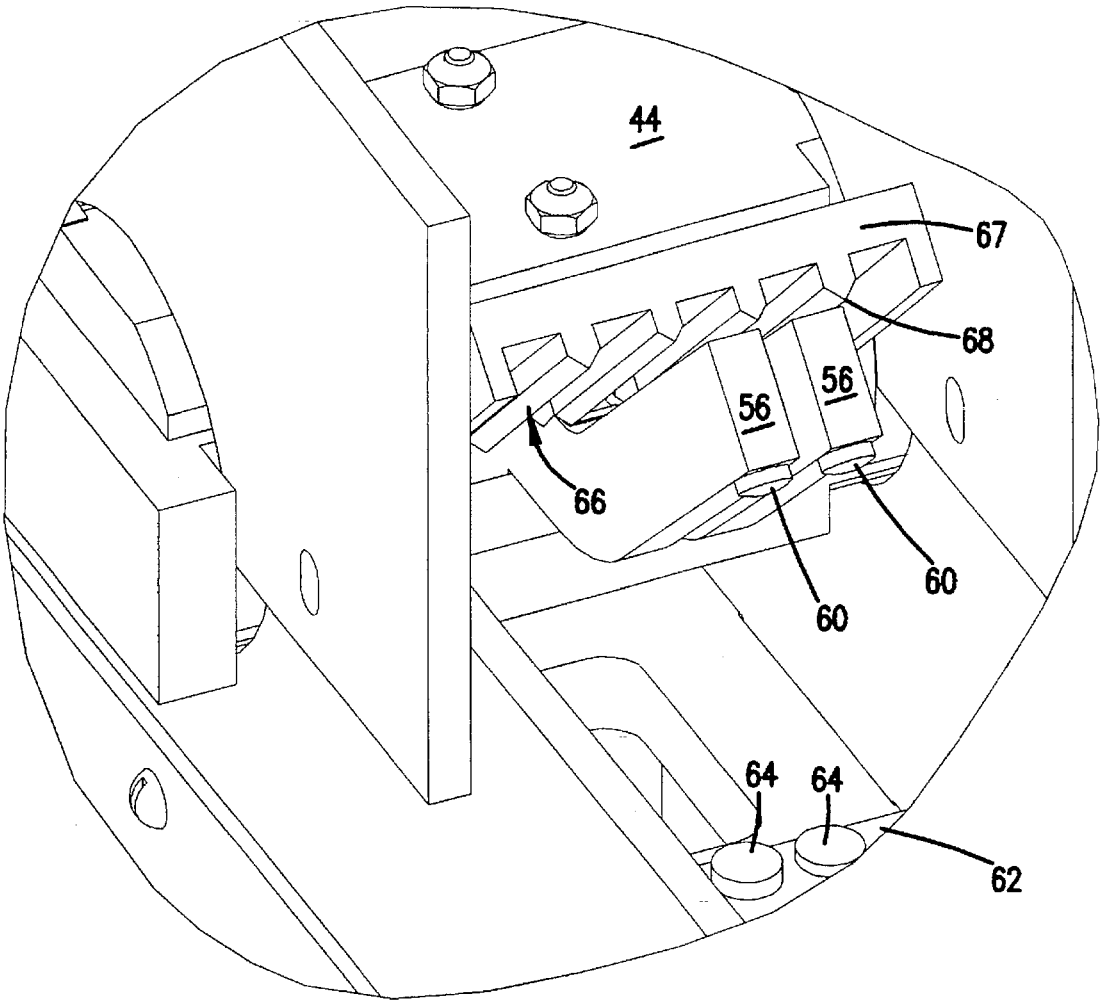
FIG. 2 is an enlarged perspective view of moveable contacts, stationary contacts, catches, and crossbar, etc.

As shown in FIG. 2, the moveable contacts 56 are disposed in the neutral position. As shown in FIG. 11, the moveable contacts 56 are disposed in the first closed position whereby the contacting ends 60 of the moveable contacts 56 make contact with the contacting ends 64 of the stationary contacts 62. Each set of the stationary contacts 62 is connected to a power supply, for example, one set is connected to a main power supply, and the other set is connected to an emergency standby power supply, or vice versa.

Figure 12:
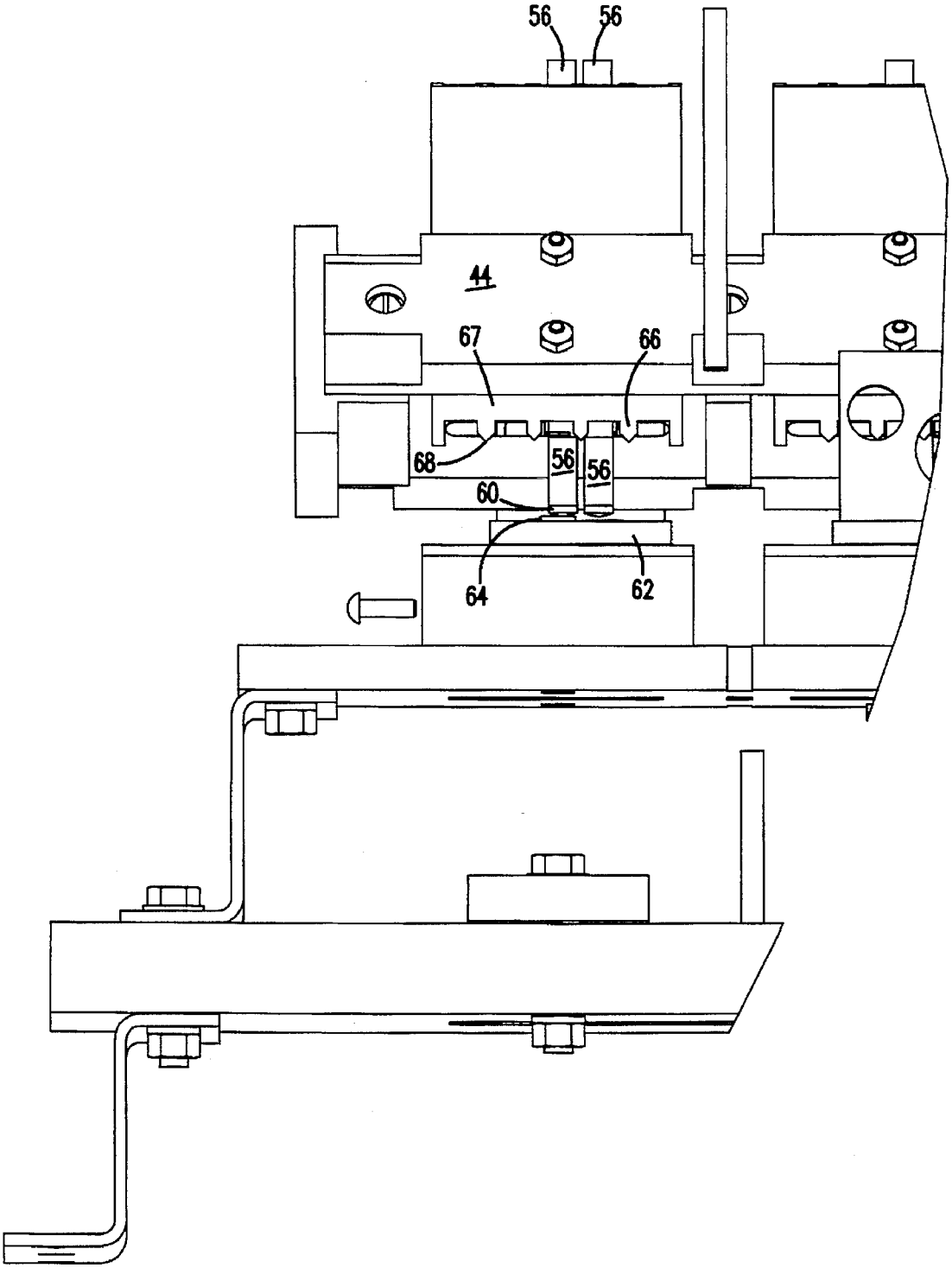
FIG. 12 is a front elevational view of the moveable contacts being locked by a catch.

As also shown in FIGS. 1 and 2, a catch 66 is disposed between each of two neighboring moveable contacts 56 and extends along the moveable contacts 56. Alternatively, the catch 66 is disposed between each of two neighboring moveable contacts 56 but does not extend along the moveable contacts 56. For example, the catch can be designed to a certain shaped pin (not shown) which is inserted between the neighboring moveable contacts 56 to serve the same function as the catch 66. It is appreciated that other types of locking members can be used. The catches 66 are used to maintain the contact between the moveable contacts 56 and the stationary contacts 62 upon occurrence of a "fault" current or other unexpected conditions. When a "fault" current passes through the contacting ends 64, 60, electromagnetic repulsive forces of very high magnitude are generated at the contacting ends 64, 60. These forces cause the contacting ends 64, 60 to lift from their normally closed position, thus causing electrical arc and eventually the contacting ends 64, 60 weld together, rendering the switch inoperable. In addition, the same fault current also causes the moveable contacts to come closer to each other. The attraction of the moveable contacts 56 makes the moveable contacts engage with and lock against the catches 66. Each of the catches 66 has a tip portion 68 including two oblique side surfaces. As shown in FIG. 12, when the moveable contacts 56 attract to each other, the oblique side surfaces force the moveable contacts 56 downward to maintain the contact with the stationary contacts 62.

Figure 9:
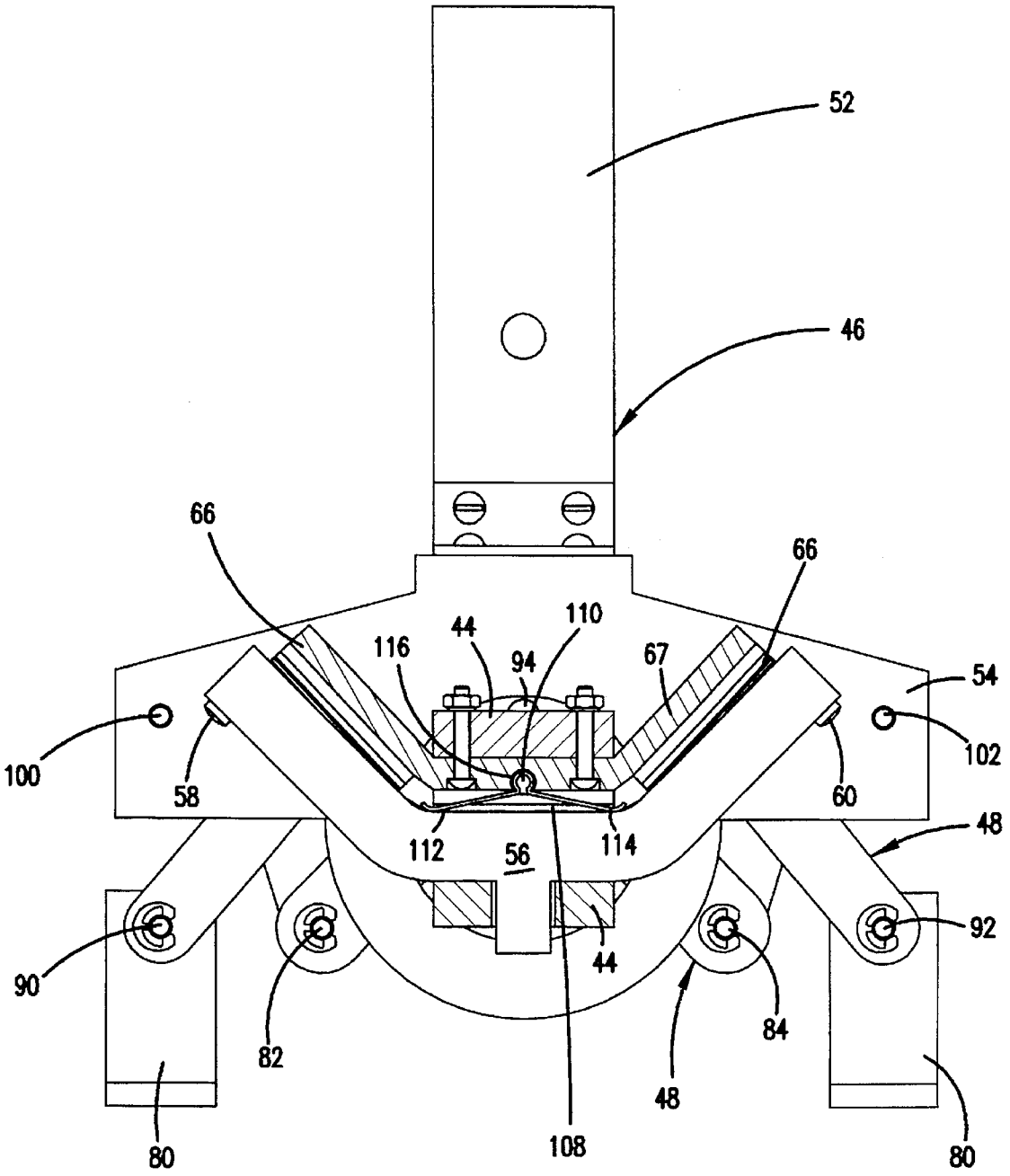
FIG. 9 is a cross-sectional view along line II—II as shown in FIG. 8 showing a first embodiment of a spring in conjunction with the moveable contacts.

Further shown in FIG. 1, the catches 66 are integral into a catch block 67. As shown in FIG. 9, the catch block 67 is disposed between the crossbar 44 and the moveable contacts 56.

Figure 3:
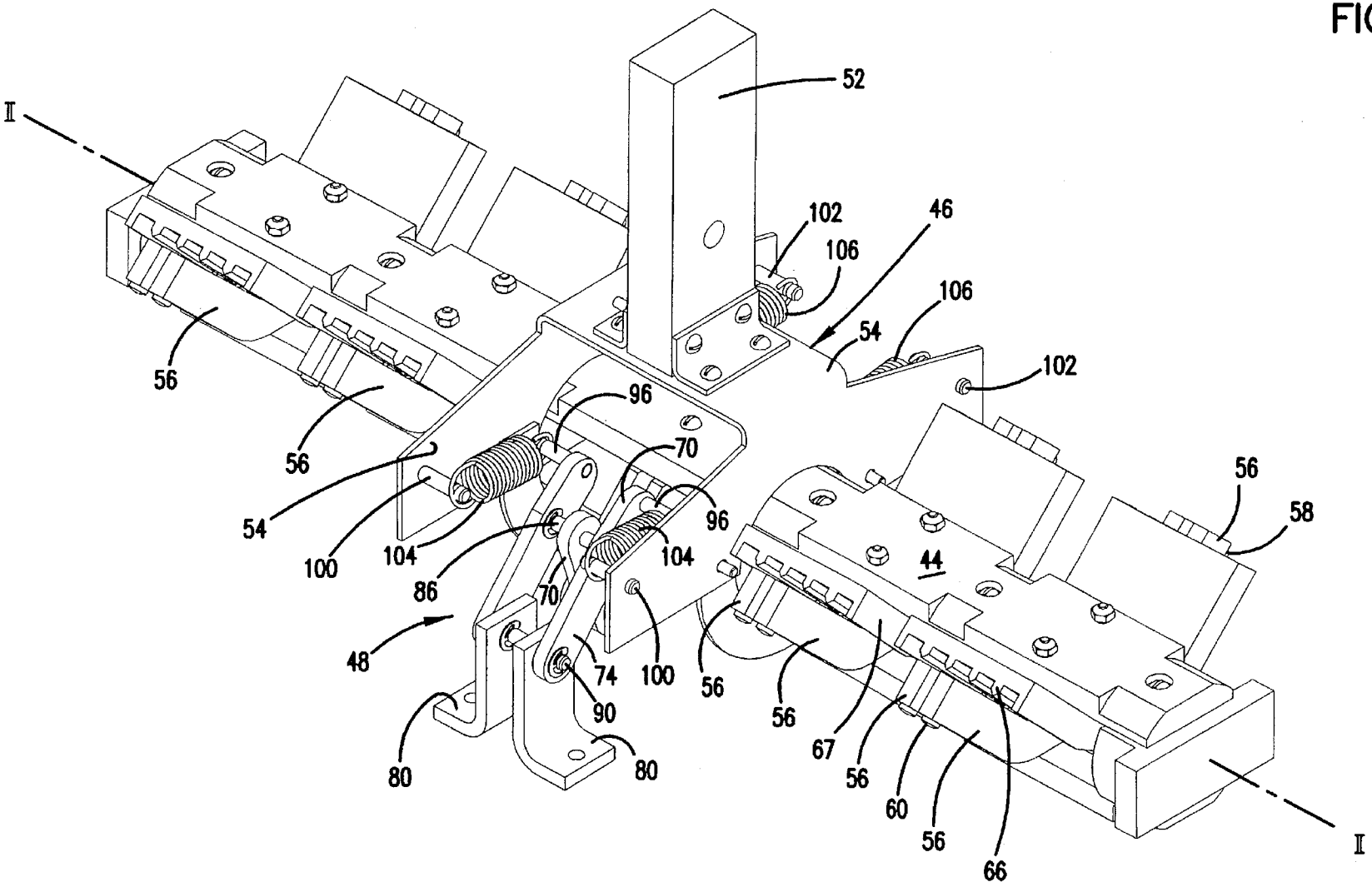
FIG. 3 is a perspective view of the toggle mechanism and the crossbar which carries the moveable contacts.

As shown in FIGS. 1 and 3, the handle portion 52 of the handle 46 is mounted on the body portion 54. Alternatively, the handle portion 52 can be integral with the body portion 54 so that it becomes a one-piece handle. The crossbar 44 passes through between the linkage 48 and the handle 46 so that the parts, including part of the handle 46 and part of the linkage 48, on one side of the longitudinal axis A—A of the crossbar 44 is generally symmetrical to those of on the other side.

Figure 4:
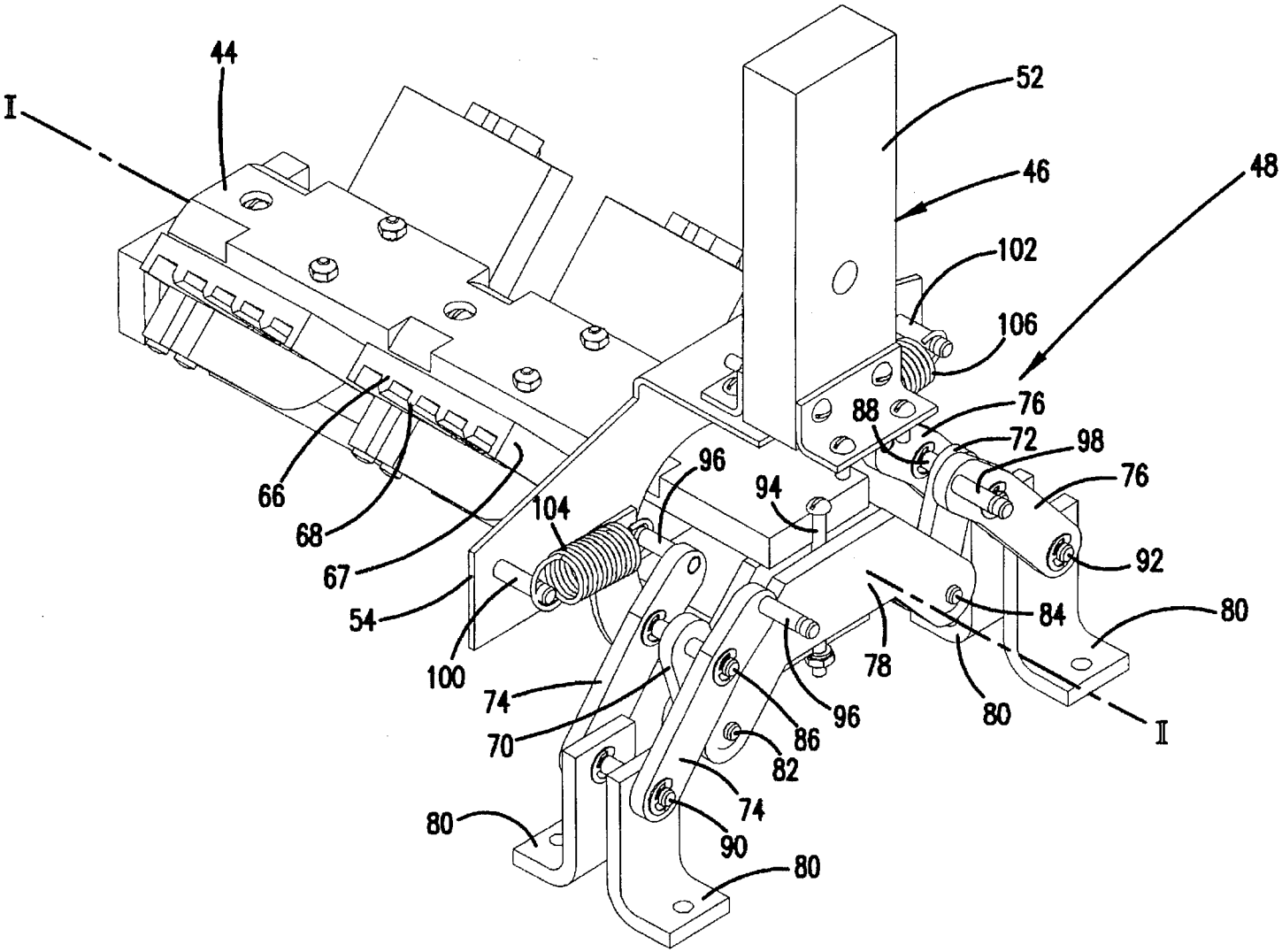
FIG. 4 is a perspective view of the toggle mechanism and the crossbar which carries the moveable contacts, as shown in FIG. 3, but having one side removed for illustration, which shows a six-bar linkage.

FIG. 4 illustrates the six-bar linkage 48. It is appreciated that other types of multi-bar linkages can be used in accordance with the principles of the present invention. For the purposes of illustration, in FIG. 4, a part of the handle body portion 54 and a part of the crossbar 44 are removed as compared to FIG. 3. The linkage 48 includes a first bar (or link) 70, a second bar 72 which is symmetrical to the first bar 70, a third bar 74, a fourth bar 76 which is symmetrical to the third bar 74, a fifth bar 78 which is bridged between the first bar 70 and the second bar 72, and a sixth bar 80.

A first end of the first bar 70 is pivotally connected to a first end of the fifth bar 78 through a pivot pin 82. A first end of the second bar 72 is pivotally connected to a second end of the fifth bar 78 through a pivot pin 84.

The third bar 74 includes two similar pieces which are spaced apart from each other but are connected by a pivot pin 86. A second end of the first bar 70 is disposed between the two pieces and is pivoted around the pivot pin 86. Likewise, the fourth bar 76 also includes two similar pieces which are spaced apart from each other but are connected by a pivot pin 88. A second end of the second bar 72 is disposed between the two pieces and is pivoted around the pivot pin 88.

Alternatively, each of the third and fourth bars 74, 76 can be only one piece. Accordingly, a second end of the first bar 70 is connected to the third bar and is pivoted around the pivot pin 86. Likewise, a second end of the second bar 72 is connected to the fourth bar 76 and is pivoted around the pivot pin 88. It is appreciated that other configuration of the bars in keeping with the principles of the present invention can be used.

Back to the preferred embodiment, the pivot pin 86 passes through the two pieces of the third bar 74 and is a distance away from a first end of the third bar 74. Similarly, the pivot pin 88 passes through the two pieces of the fourth bar 76 and is a distance away from a first end of the fourth bar 76. The distance can be variable, which depends on different configurations as required.

Another pivot pin 90 passes through the two pieces of the third bar 74 at a second end of the third bar 74 and further connects to the two pieces at the second end. Likewise, another pivot pin 92 passes through the two pieces of the fourth bar 76 at a second end of the fourth bar 76 and further connects to the two pieces at the second end.

As shown in FIG. 4, the fifth bar 78 crosses over the longitudinal axis A—A of the crossbar 44. The fifth bar 78 also includes two pieces which are spaced apart and are connected by the pivot pins 82, 84. Alternatively, the fifth bar 78 can be only one piece. It is appreciated that other configuration of the fifth bar 78 in keeping with the principles of the present invention can be used.

Figure 5:
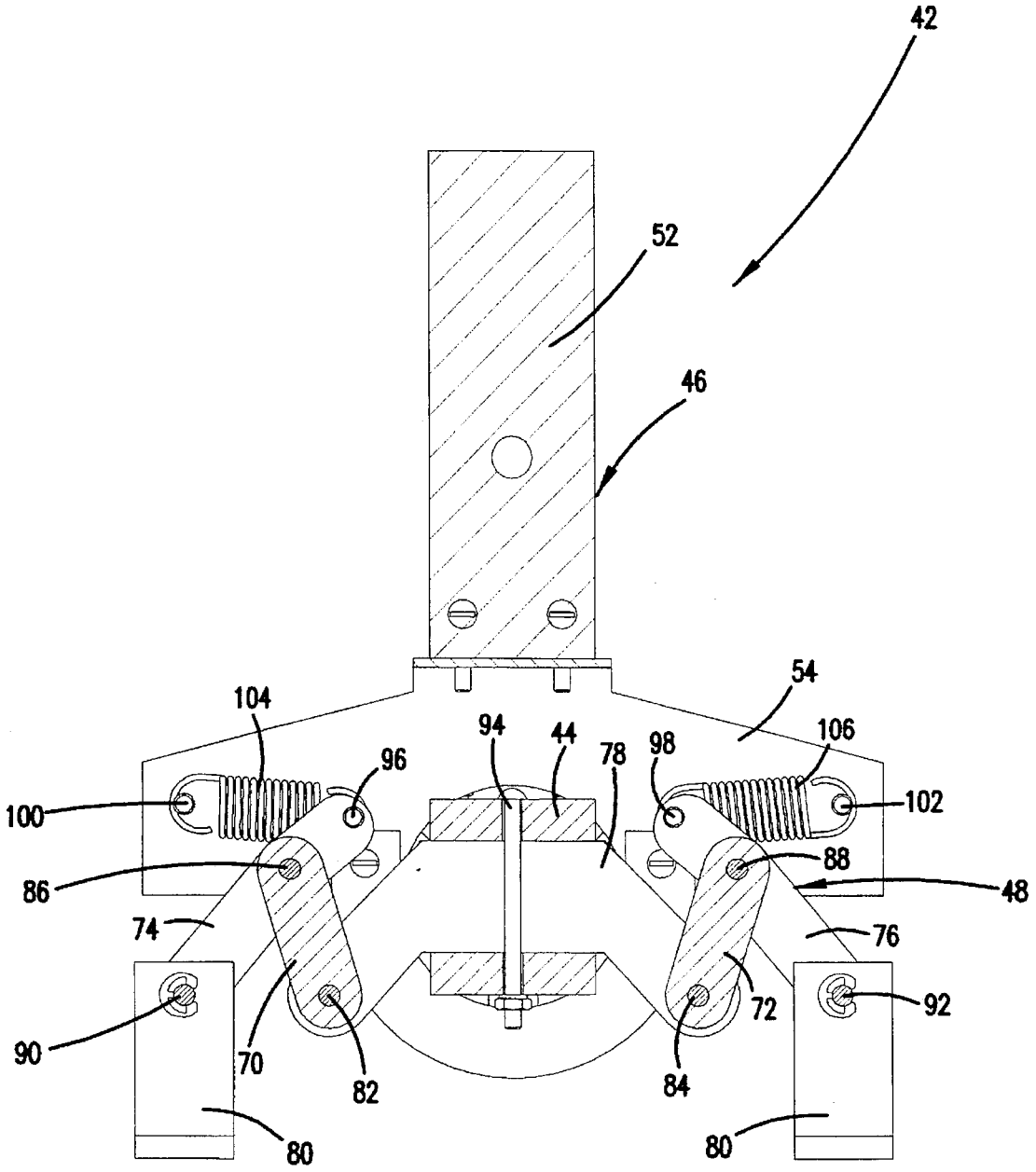
FIG. 5 is a cross-sectional view of the toggle mechanism and the crossbar which carries the moveable contacts, as shown in FIG. 4, wherein the toggle mechanism is disposed in a neutral open position.

As shown in FIG. 5, the handle 46 is mounted on the crossbar 44. The crossbar 44 is retained by the body portion 54 of the handle 46 and the fifth bar 78. In addition, a fastener 94, which vertically passes through the space between the two pieces of the fifth bar 78, mounts the crossbar 44 onto the fifth bar 78.

The sixth bar 80 includes four similar pieces wherein two pieces are connected to the two pieces of the third bar 74, respectively, at the second end of the third bar 74 by the pivot pin 90, and the other two pieces are connected to the two pieces of the fourth bar 76, respectively, at the second end of the fourth bar 76 by the pivot pin 92. The sixth bar 80 is stationary so that the third bar 74 is pivoted relative to the sixth bar 80 around the pivot pin 90, and the fourth bar 76 is pivoted relative to the sixth bar 80 around the pivot pin 92. It is appreciated that the four similar pieces can be integrated into one piece or two pieces. Alternatively, the sixth bar 80 only includes one piece. It is appreciated that other configuration of the sixth bar 80 in keeping with the principles of the present invention can be used.

Back to the preferred embodiment as shown in FIG. 5, a projecting rod 96 is vertically disposed at the first end of the third bar 74 in each of the two pieces of the third bar 74. A projecting rod 98 is vertically disposed at the first end of the fourth bar 76 in each of the two pieces of the fourth bar 76. The corresponding projecting rods 100, which are generally parallel to the projecting rods 96, vertically extend from the body portion 54 of the handle 46. The corresponding projecting rods 102, which are generally parallel to the projecting rods 98, extend from the body portion 54. The rods 100 and the rods 102 are generally symmetrical to each other with respect to the longitudinal axis A—A.

As shown in FIG. 3, two springs 104 are connected between the rods 96 and the rods 100, respectively, and two springs 106 are connected between the rods 98 and the rods 102, respectively.

Figure 6:
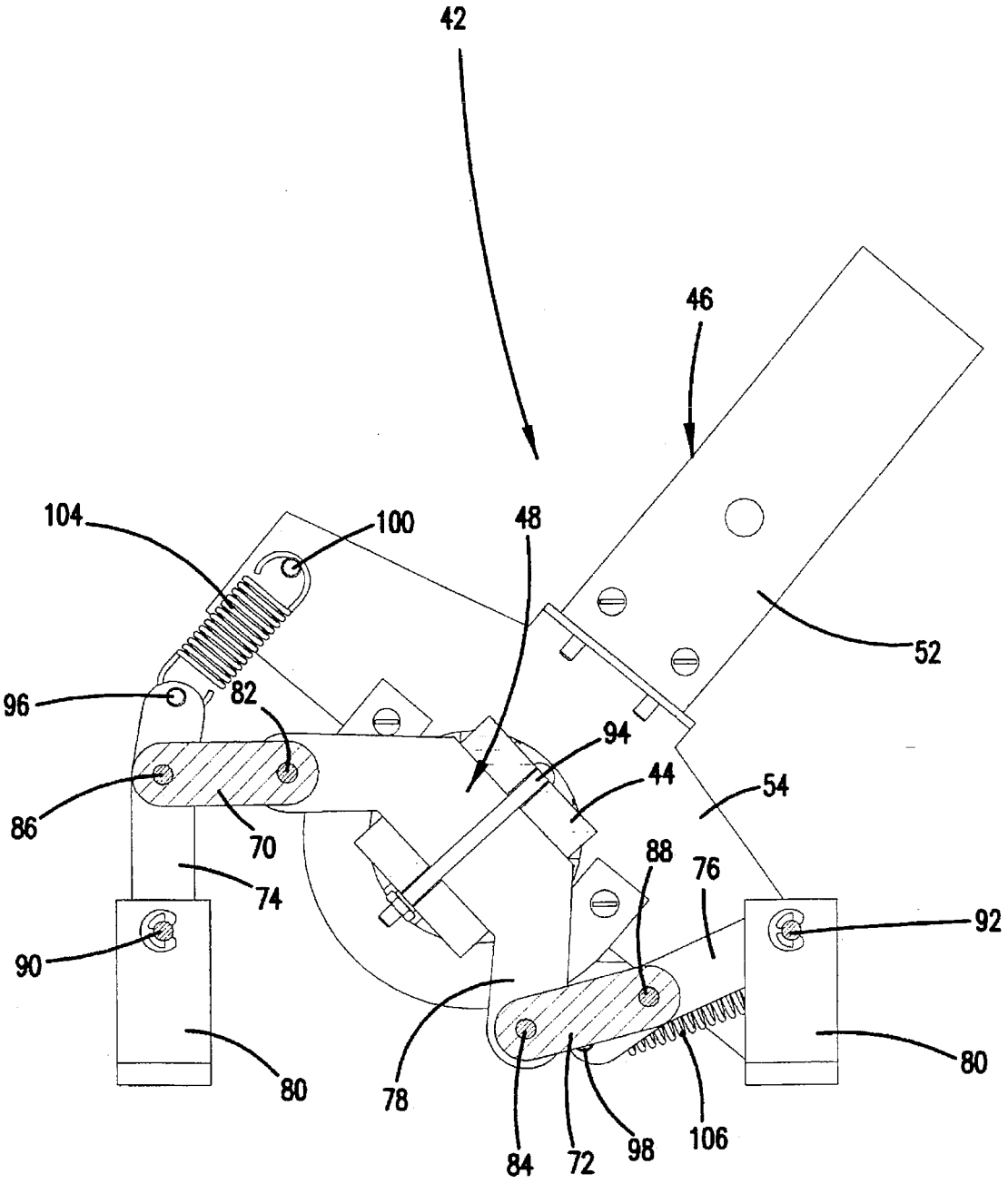
FIG. 6 is a cross-sectional view of the toggle mechanism and the crossbar which carries the moveable contacts, as shown in FIG. 4, wherein the toggle mechanism is disposed in a closed position.

When the handle 46 is rotated from the open neutral position, as shown in FIGS. 3–5, to one of the closed positions, as shown in FIG. 6, the springs 106 connected between the rods 98 and rods 102 are extended. After the handle 46 rotates downward to a certain angle, the end of each of the springs 106 which is in connection with the rod 102 crosses a line joining pivot pins 88 and 92. Upon such occurrence, the fourth bar 76 rotates very fast while utilizing the energy stored in the spring 106 and thus forcing the second bar 72 to rotate accordingly. The pivotal rotation of the second bar 72 in turn forces the fifth bar 78 to rotate in a same direction as that of the handle 46. As discussed above, the crossbar 44 is retained between the fifth bar 78 and the body portion 54 of the handle 46. As a result, the crossbar 44 is forced to rotate by the fifth bar 78 of the linkage 48.

Accordingly, the moveable contacts 56, which are carried by the crossbar 44, make the contact with one set of the stationary contacts 62 in a closed position. In the electric transfer switch 40, the moveable contacts 56 are connected to various electric loads, and one set of the stationary contacts 62 are connected to a main power supply which supplies the power to the various loads in the normal operation. When a power outage occurs caused by a variety of reasons, for example, earthquake, flooding, bombing, or other utility blackouts, the electric transfer switch 40 is brought to the neutral position, as shown in FIGS. 3–5, so that the energy stored (for example, in the induction motors, not shown) is dissipated. These induction motors start acting as a generator when the power is gone. After a short period of time, they lose energy, and power transfer (i.e., connecting to the standby power source) becomes harmless. Then, the moveable contacts 56 connect to the stationary contacts 62 in a second closed position so that the loads are supplied by the standby emergency power supply or other types of power utility.

Figure 7:
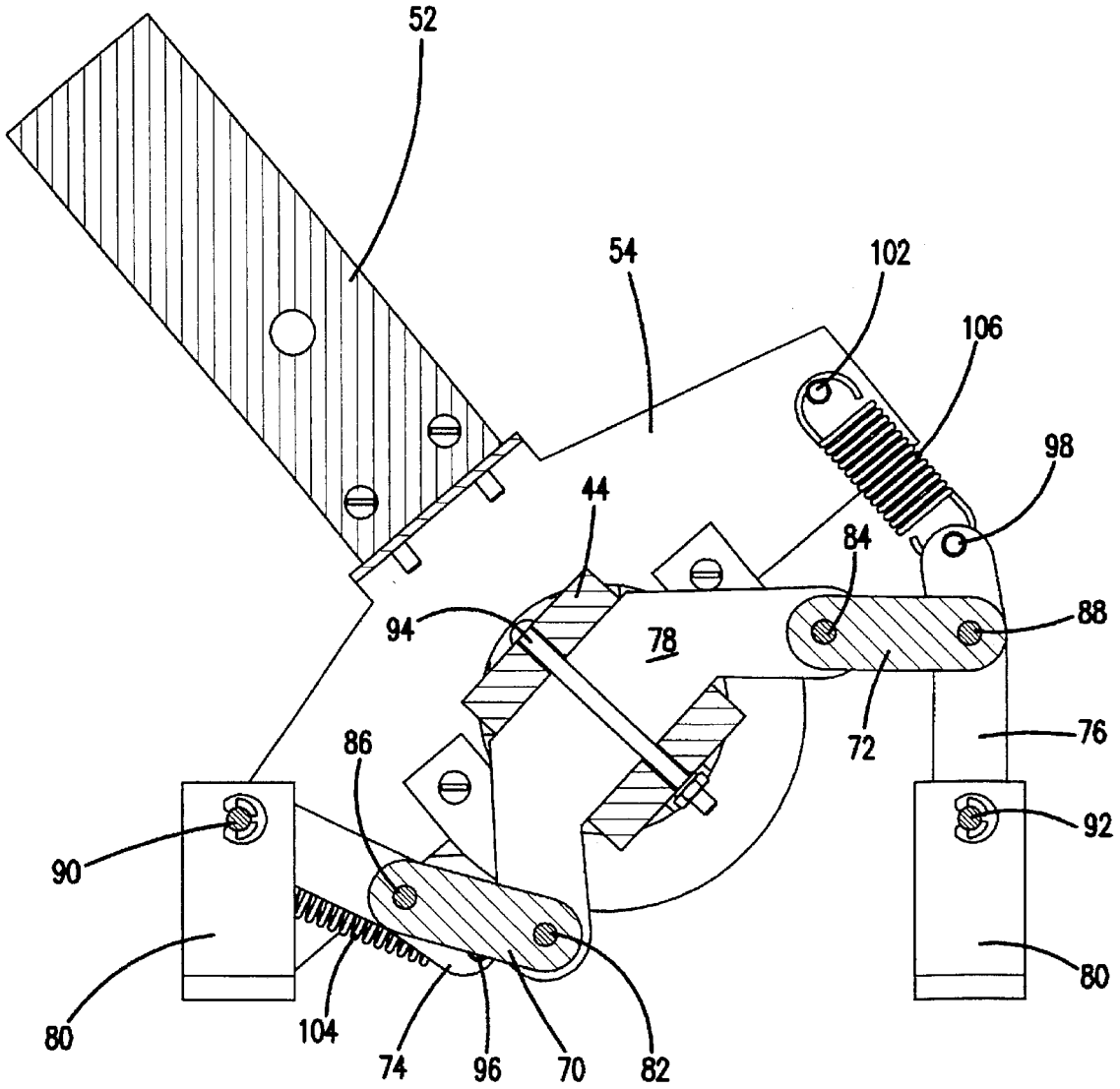
FIG. 7 is a cross-sectional view of the toggle mechanism and the crossbar which carries the moveable contacts, as shown in FIG. 4, wherein the toggle mechanism is disposed in another closed position.

In making such transfer, the handle 46 is rotated from the previously described closed position as shown in FIG. 6, to the neutral position as shown in FIG. 5, and further to the other closed position as shown in FIG. 7. In particular, to restore the switch 40 to the neutral open position, the handle 46 is rotated in an opposite direction. Once the end of each of the springs 106 which is in connection with the rod 102 moves upward and crosses the line joining pivot pins 88 and 92, the fourth bar 76 rotates very fast while utilizing the energy stored in the spring 106 and thus forces the second bar 72 to rotate upward accordingly. The pivotal rotation of the second bar 72 in turn forces the fifth bar 78 to rotate in the same direction as that of the handle 46. As a result, the crossbar 44 is forced to rotate back to the open neutral position.

Accordingly, the moveable contacts 56, which are carried by the crossbar 44, are disconnected from the stationary contacts 62. At this point, the electric loads are switched from the normal main power supply to a non-power-supply neutral position. After a controllable time period, the electric transfer switch 40 is switched to the standby emergency power supply. The same operation is performed to make contact between the moveable contacts 56 with the stationary contacts 62 to connect to the standby emergency power supply. This is shown in FIG. 7, which is generally a mirror image of making contact between the moveable contacts 56 with the stationary contacts 62 to connect to the main power supply as shown in FIG. 6.

Figure 8:
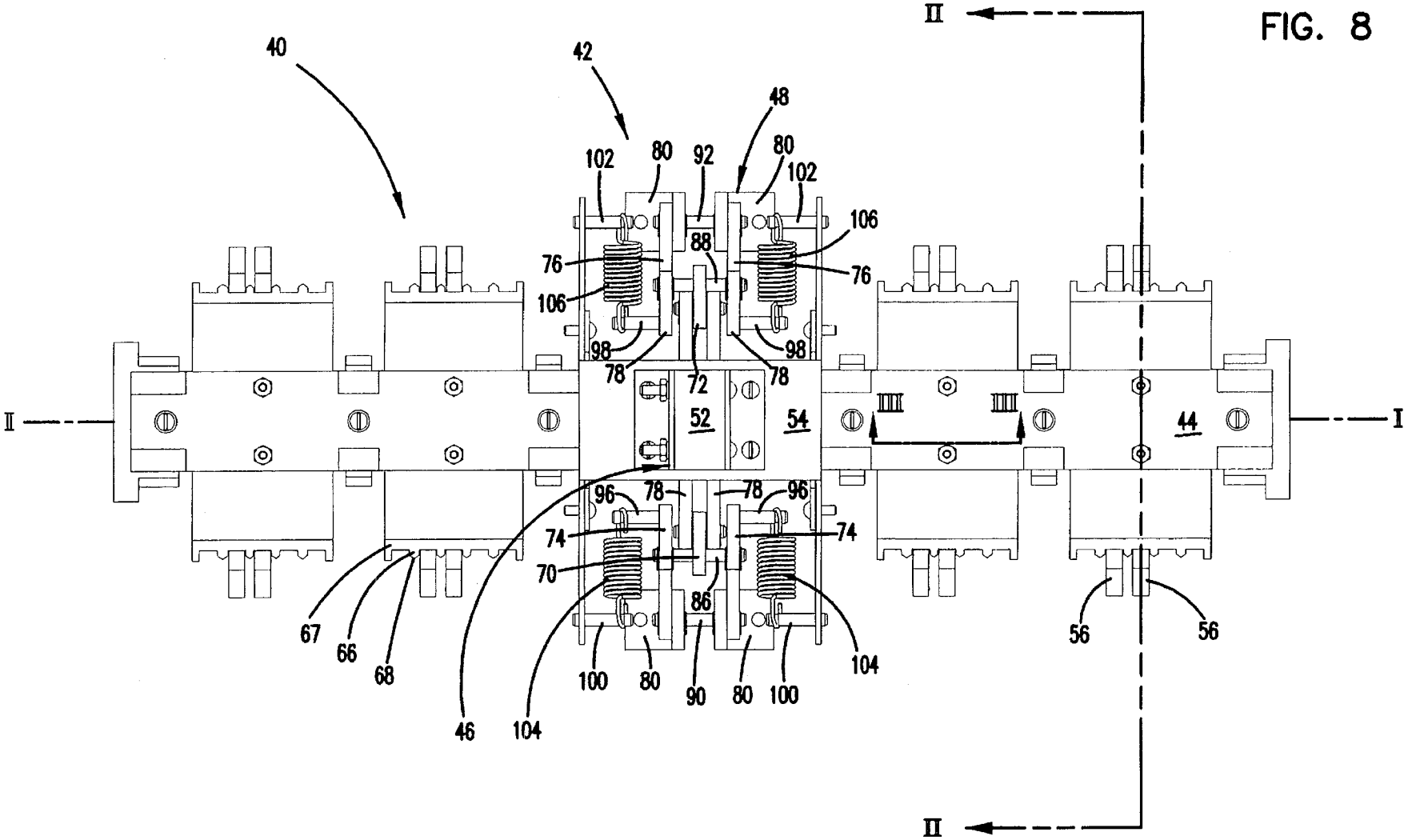
FIG. 8 is a top plane view of the toggle mechanism and the crossbar which carries the moveable contacts, as shown in FIG. 3.

FIG. 8 shows a top plane view of the electric transfer switch 40 having the toggle mechanism 48 be in the neutral position.

In FIG. 9, a plurality of leaf springs 108 (only one is shown here) are biasedly disposed between the catch block 67 and the moveable contacts 56. Each of the leaf springs 108 includes a loop portion 110 and two leg portions 112, 114. The loop portion 110 is retained in a recess 116 of the catch block 67. The two leg portions 112, 114 biasedly contact two sides of a moveable contact 56, respectively. Accordingly, the moveable contact 56 is forced downward to maintain the contact between the moveable contact 56 and the corresponding stationary contact 62 in a closed position so as to prevent the moveable contact 56 from incidentally separating from the stationary contact 62.

Figure 10:
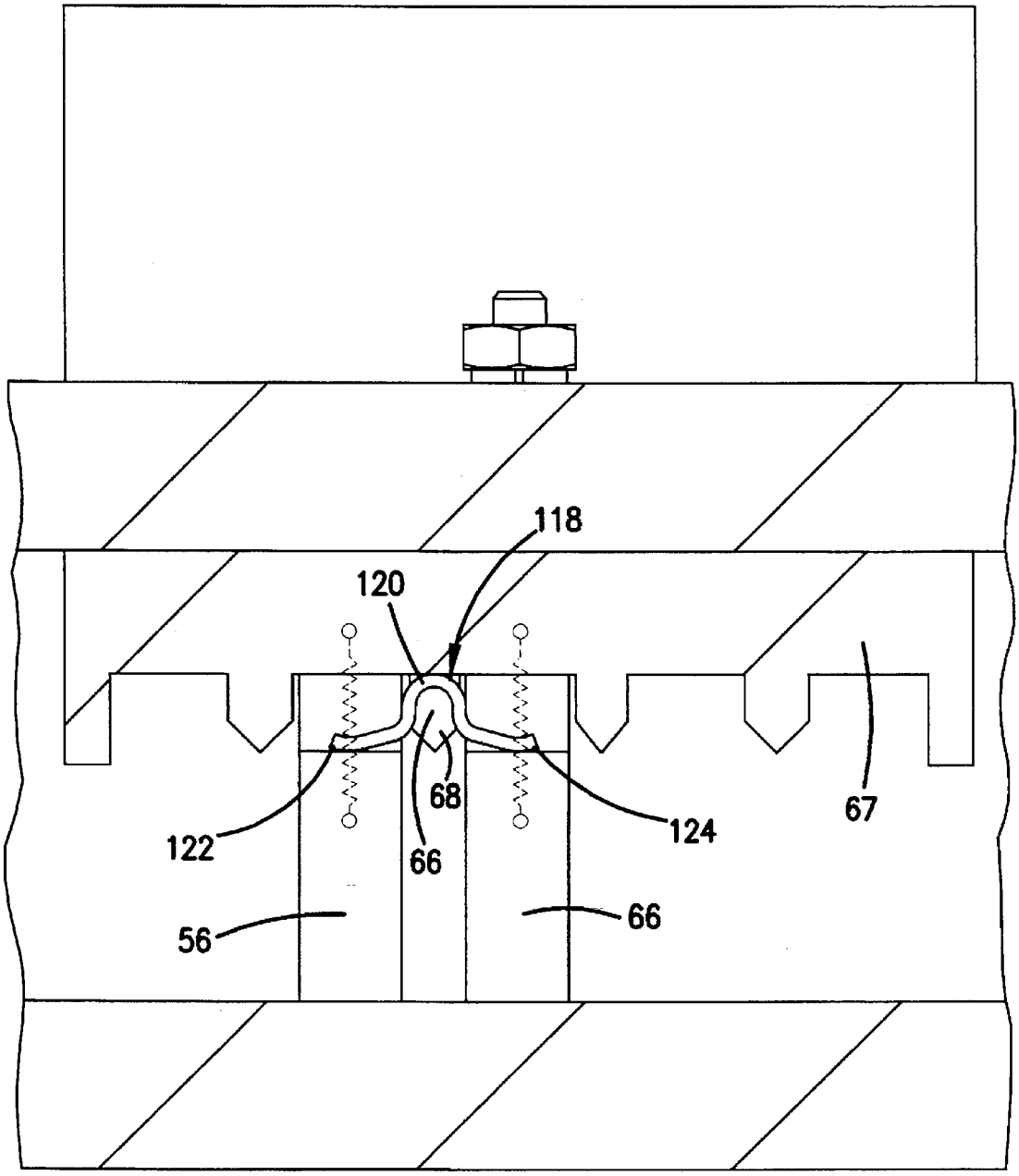
FIG. 10 is a cross-sectional view along line III—III as shown in FIG. 8 showing a second embodiment and a third embodiment of a spring in conjunction with the moveable contacts.

In a second embodiment as shown in FIG. 10, a plurality of leaf springs 118 (only one is shown here) are disposed between the catch block 67 and the neighboring moveable contacts 56. Each of the leaf springs 118 has a loop portion 120 and two leg portions 122, 124. The loop portion 120 is retained in a recess (not shown) of the catch 66. The two leg portions 122, 124 of the leaf spring 118 biasedly contact two neighboring moveable contacts 56 so that the leaf spring 118 prevents the moveable contacts 56 from disconnecting from the stationary contacts 62.

Either or both the leaf spring 108 and/or the leaf spring 118 can be used in the electric transfer switch 40. It is appreciated that other types of springs, such as a compression spring, etc., can be used to force the moveable contact 56 downward so as to maintain contact between the moveable contacts and the stationary contacts. Such compression springs, as a third embodiment, are shown in phantom lines in FIG. 10.

Figure 13:
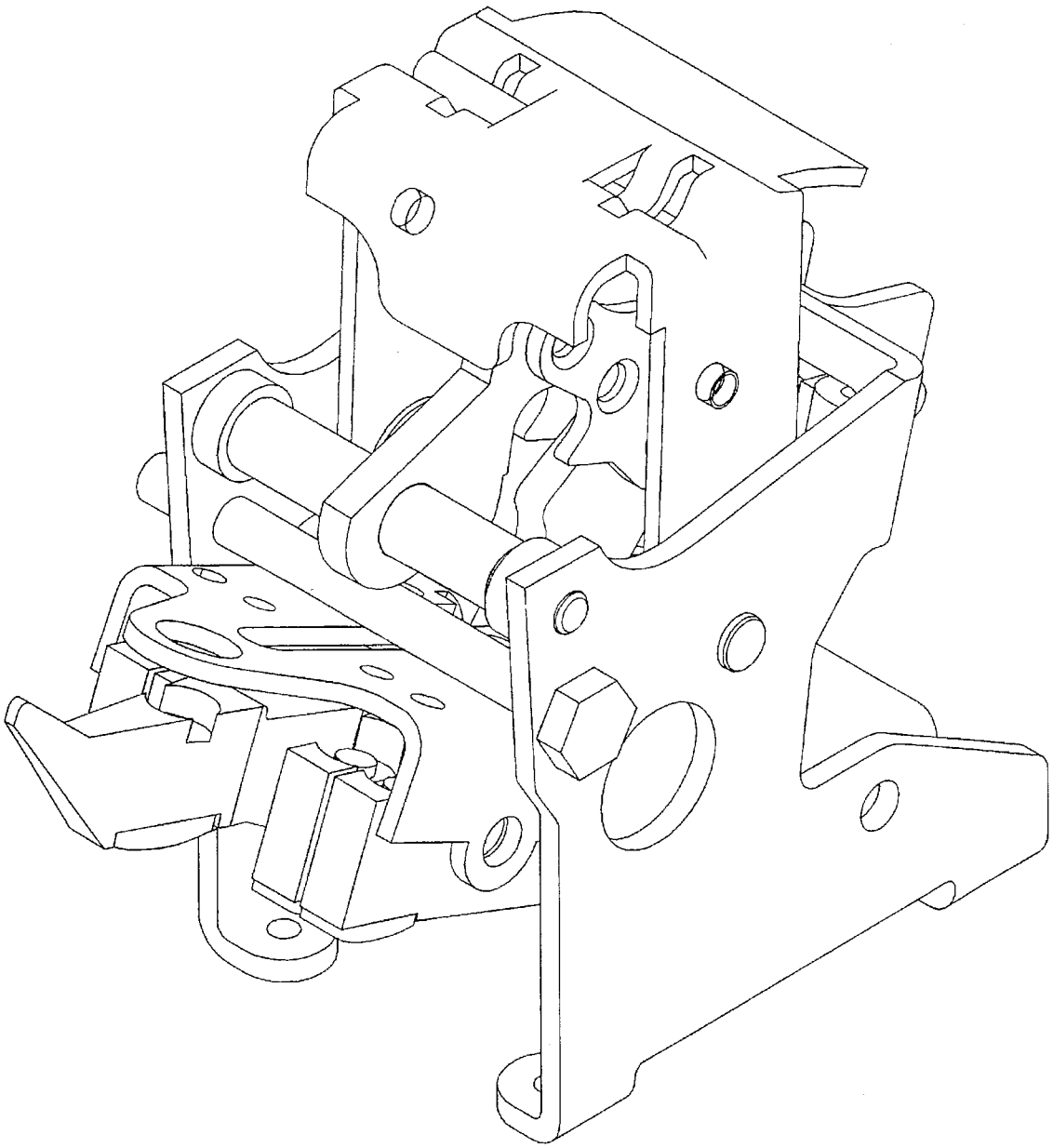
FIG. 13 (PRIOR ART)
FIG. 13 is a perspective view of a part of a conventional electric transfer switch without catches.
Figure 14:
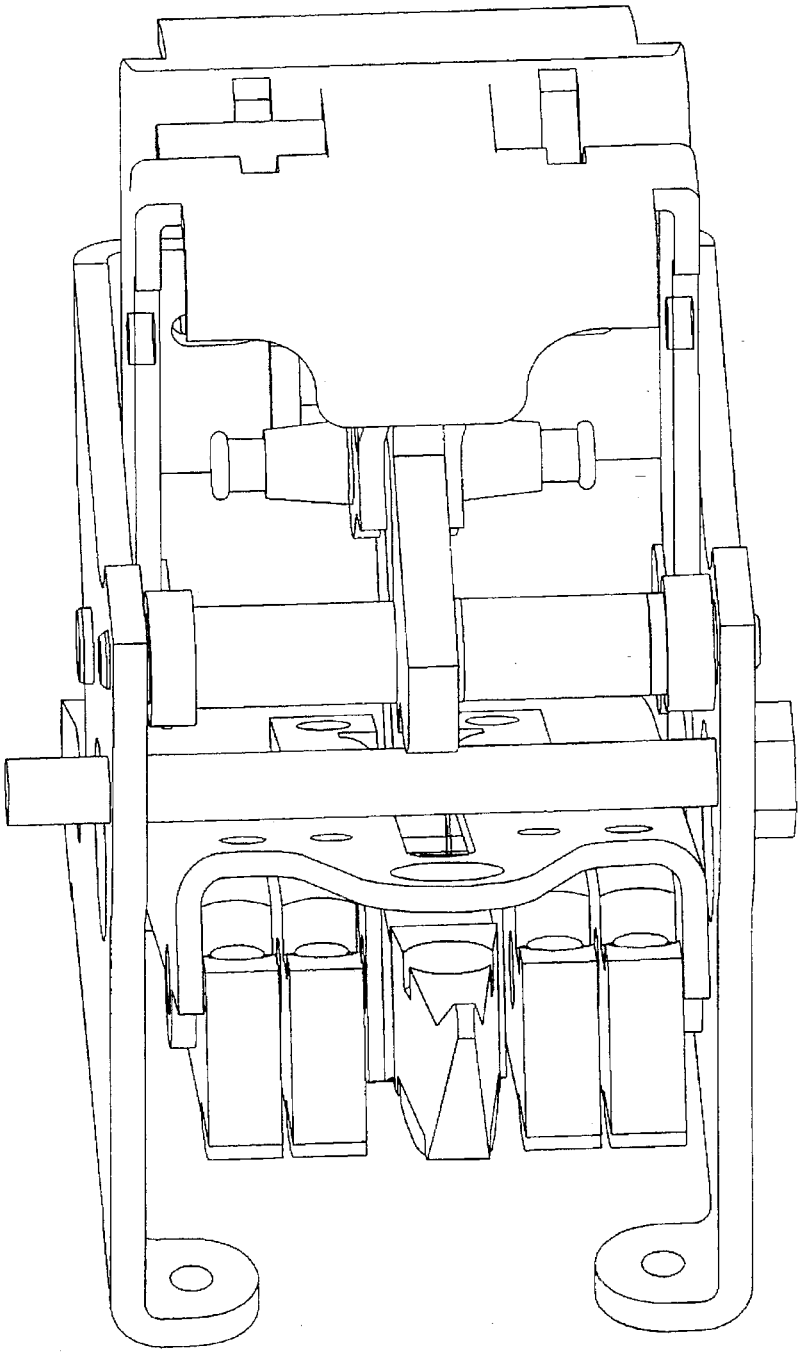
FIG. 14 (PRIOR ART)
FIG. 14 is a front elevational view of a part of the conventional electric transfer switch as shown in FIG. 13.

FIGS. 13 and 14 illustrate a part of a conventional switch where there is no catch disposed between the moveable contacts. In addition, the conventional switch does not disclose or teach the toggle mechanism and other embodiments as described above and claimed below.

It will be appreciated that alternate embodiments in keeping with the principles of the present invention might be utilized. It is to be understood, however, that even though numerous characteristics and advantages of the invention have been set forth in the foregoing description, together with details of the structure and function of the invention, the disclosure is illustrative only, and changes may be made in detail, especially in matters of shape, size and arrangement of parts, within the principles of the invention, to the full extent indicated by the broad general meaning of the terms in which the appended claims are expressed.

What is claimed is:

1. A toggle mechanism for opening and closing an electric transfer switch, comprising:

an elongated crossbar having a longitudinal axis;

a handle, the handle transversely switching the electric transfer switch with respect to the longitudinal axis among first, second, and third positions, the handle being mounted on the crossbar and being a single handle;

a multi-bar linkage including a plurality of bars and a plurality of pivot pins which connect the bars together, the elongated crossbar passing through an area defined between the handle and the multi-bar linkage and being retained therein, wherein the longitudinal axis of the elongated crossbar is perpendicular to the multi-bar linkage;

at least two springs being connected between the multi-bar linkage and the handle;

the electric transfer switch being switched from the first position to the second position when the handle is rotated and when one end of one of the springs crosses a line joining two of the pivot pins, and the electric transfer switch being switched from the second position back to the first position when the handle is counter-rotated and when the end of the one spring crosses back the line joining the two pivot pins; and the electric transfer switch being switched from the first position to the third position when the handle is further counter-rotated and when one end of another spring crosses a line joining another two pivot pins, and the electric transfer switch being switched from the third position back to the first position when the handle is rotated and when the end of the another spring crosses back the line joining the another two pivot pins.

2. A toggle mechanism in accordance with claim 1, wherein when the handle rotates from one of the three positions to another position, energy is stored in the springs whereby at least one of the springs is extended.

3. A toggle mechanism for opening and closing an electric transfer switch, comprising:

a crossbar having a longitudinal axis;

a handle, the handle transversely switching the electric transfer switch with respect to the longitudinal axis among first, second, and third positions, the handle being mounted on the crossbar;

a multi-bar linkage including a plurality of bars and a plurality of pivot pins which connect the bars together, the crossbar being disposed between the handle and the multi-bar linkage;

at least two springs being connected between the multi-bar linkage and the handle;

the electric transfer switch being switched from the first position to the second position when the handle is rotated and when one end of one of the springs crosses a line joining two of the pivot pins, and the electric transfer switch being switched from the second position back to the first position when the handle is counter-rotated and when the end of the one spring crosses back the line joining the two pivot pins;

the electric transfer switch being switched from the first position to the third position when the handle is further counter-rotated and when one end of another spring crosses a line joining another two pivot pins, and the electric transfer switch being switched from the third position back to the first position when the handle is rotated and when the end of the another spring crosses back the line joining the another two pivot pins; and wherein the multi-bar linkage includes six bars, the first and second bars are disposed on opposite sides of the longitudinal axis of the crossbar, third and fourth bars are disposed on the opposite sides of the longitudinal axis of the crossbar, the fifth bar is bridged between the first bar and the second bar and is pivotally connected to the first bar by a first pivot pin and to the second bar by a second pivot pin, and the sixth bar is connected to the third bar and to the fourth bar by a third and fourth pivot pins, the first bar is pivotally connected to the third bar at proximate a middle portion of the third bar by a fifth pivot pin, the second bar is pivotally connected at proximate a middle portion of the fourth bar by a sixth pivot pin.

4. An electric transfer switch, comprising:

a toggle mechanism for opening and closing an electric transfer switch, the toggle mechanism comprising:

a crossbar having a longitudinal axis;

a handle, the handle transversely switching the electric transfer switch with respect to the longitudinal axis among first, second, and third positions, the handle being mounted on the crossbar;

a multi-bar linkage including a plurality of bars and a plurality of pivot pins which connect the bars together, the crossbar being disposed between the handle and the multi-bar linkage;

at least two springs being connected between the multi-bar linkage and the handle;

the electric transfer switch being switched from the first position to the second position when the handle is rotated and when one end of one of the springs crosses a line joining two of the pivot pins, and the electric transfer switch being switched from the second position back to the first position when the handle is counter-rotated and when the end of the one spring crosses back the line joining the two pivot pins; and the electric transfer switch being switched from the first position to the third position when the handle is further counter-rotated and when one end of another spring crosses a line joining another two pivot pins, and the electric transfer switch being switched from the third position back to the first position when the handle is rotated and when the end of the another spring crosses back the line joining the another two pivot pins;

a plurality of moveable contacts being mounted on the crossbar, the moveable contacts being connected to electrical loads;

a first set of stationary contacts being disposed at the second position, the first set of the stationary contacts being connected to a first power supply;

a second set of stationary contacts being disposed at the third position, the second set of the stationary contacts being connected to a second power supply;

a first set of the moveable contacts connecting to the first set of the stationary contacts after the handle switches the toggle mechanism from the first position to the second position, and a second set of the moveable contacts connecting to the second set of the stationary contacts after the handle switches the toggle mechanism from the first position to the third position;

a spring member biasedly connecting to both sides of each of the moveable contacts so as to force the moveable contacts toward the corresponding stationary contacts to maintain contact therebetween; and a catch being disposed between each two neighboring moveable contacts so that when a fault current passes through contact tips between the moveable contacts and the corresponding stationary contacts, the moveable contacts are attracted towards each other to engage with the catch so that the moveable contacts are prevented from being lifted because of high electromagnetic repulsive forces generated at the contract tips.

5. An electric transfer switch in accordance with claim 4, wherein the handle is a single handle.

6. An electric transfer switch, comprising:

a toggle mechanism, comprising:

a crossbar having a longitudinal axis;

a handle, the handle transversely switching the electric transfer switch with respect to the longitudinal axis among first, second, and third positions, the handle being mounted on the crossbar;

a multi-bar linkage including a plurality of bars and a plurality of pivot pins which connect the bars together, the crossbar being disposed between the handle and the multi-bar linkage;

at least two springs being connected between the multi-bar linkage and the handle;

the electric transfer switch being switched from the first position to the second position when the handle is rotated and when one end of one of the springs crosses a line joining two of the pivot pins, and the electric transfer switch being switched from the second position back to the first position when the handle is counter-rotated and when the end of the one spring crosses back the line joining the two pivot pins; and the electric transfer switch being switched from the first position to the third position when the handle is further counter-rotated and when one end of another spring crosses a line joining another two pivot pins, and the electric transfer switch being switched from the third position back to the first position when the handle is rotated and when the end of the another spring crosses back the line joining the another two pivot pins;

a plurality of moveable contacts being mounted on the crossbar, the moveable contacts being connected to electrical loads;

a first set of stationary contacts being disposed at the second position, the first set of the stationary contacts being connected to a first power supply;

a second set of stationary contacts being disposed at the third position, the second set of the stationary contacts being connected to a second power supply; and a first set of the moveable contacts connecting to the first set of the stationary contacts at the second position after the handle switches the toggle mechanism from the first position to the second position, and a second set of the moveable contacts connecting to the second set of the stationary contacts at the third position after the handle switches the toggle mechanism from the first position to the third position, the second and third positions being disposed on opposite sides of the longitudinal axis of the crossbar.

7. An electric transfer switch in accordance with claim 6, wherein the handle is a single handle.

8. An electric transfer switch, comprising:

a toggle mechanism including a crossbar having a longitudinal axis, and a handle transversely switching the electric transfer switch with respect to the longitudinal axis among first, second, and third positions, the handle being mounted on the crossbar;

a plurality of moveable contacts being mounted on the crossbar, the moveable contacts being connected to electrical loads;

a first set of stationary contacts being disposed at the second position, the first set of the stationary contacts being connected to a first power supply;

a second set of stationary contacts being disposed at the third position, the second set of the stationary contacts being connected to a second power supply;

a first set of the moveable contacts connecting to the first set of the stationary contacts after the handle switches the toggle mechanism from the first position to the second position, and a second set of the moveable contacts connecting to the second set of the stationary contacts after the handle switches the toggle mechanism from the first position to the third position; and a catch being disposed between each two neighboring moveable contacts so that when a fault current passes through contact between the moveable contacts and the corresponding stationary contacts, the catch prevents the neighboring moveable contacts from separating from the corresponding stationary contacts.

9. An electric transfer switch in accordance with claim 8, further comprising a spring member biasedly connecting to both sides of each of the movable contacts so as to force the moveable contacts toward the corresponding stationary contacts to maintain contact therebetween.

10. An electric transfer switch in accordance with claim 8, wherein the handle is a single handle.

11. A toggle mechanism for opening and closing an electric transfer switch, comprising:

a crossbar having a longitudinal axis;

a handle, the handle transversely switching the electric transfer switch with respect to the longitudinal axis among first, second, and third positions, the handle being mounted on the crossbar;

a multi-bar linkage including a plurality of bars and a plurality of pivot pins which connect the bars together, the crossbar being disposed between the handle and the multi-bar linkage, wherein first and second bars of the multi-bar linkage are disposed on opposite sides of the longitudinal axis of the crossbar, third and fourth bars are disposed on the opposite sides of the longitudinal axis of the crossbar, the fifth bar is bridged between the first bar and the second bar and is pivotally connected to the first bar by a first pivot pin and to the second bar by a second pivot pin, and the sixth bar is connected to the third bar and to the fourth bar by a third and fourth pivot pins, the first bar is pivotally connected to the third bar at proximate a middle portion of the third bar by a fifth pivot pin, the second bar is pivotally connected at proximate a middle portion of the fourth bar by a sixth pivot pin;

a spring being connected between the multi-bar linkage and the handle; and the electric transfer switch being closed at the second position after the handle is rotated from the first position to the second position, the electric transfer switch also being closed at the third position after the handle is rotated from the first position to the third position.

12. A toggle mechanism in accordance with claim 11, wherein when the handle rotates from one of the three positions to another position, energy is stored in the spring.

13. A toggle mechanism in accordance with claim 11, wherein the handle is a single handle.

* * * * *